United States Patent [19]

Ross

[11] 3,967,610

[45] July 6, 1976

[54] COLD STARTING DEVICES

[75] Inventor: Gray Ernest Donald Ross, Stanmore, England

[73] Assignee: The Zenith Carburetor Company Limited, Stanmore, England

[22] Filed: Sept. 12, 1974

[21] Appl. No.: 505,227

[30] Foreign Application Priority Data

Sept. 12, 1973 United Kingdom ..... 42888/73

[52] U.S. Cl. ..... 123/179 G; 123/119 F; 261/39 D; 261/44 R

[51] Int. Cl.[2] ..... F02N 17/00

[58] Field of Search ..... 123/119 F, 180 T, 180 R, 123/179 G; 261/39 D, 50 A, 44 R

[56] References Cited

UNITED STATES PATENTS

| | | | |
|---|---|---|---|
| 2,074,471 | 3/1937 | Holley et al. | 123/119 F |
| 2,264,996 | 12/1941 | Messinger, Jr. | 123/119 F |
| 2,868,185 | 1/1959 | Bellicardi | 123/180 T |
| 3,493,217 | 3/1970 | Farley | 261/50 A |

*Primary Examiner*—Charles J. Myhre
*Assistant Examiner*—James D. Liles
*Attorney, Agent, or Firm*—Stevens, Davis, Miller & Mosher

[57] ABSTRACT

An internal combustion engine cold start device has an air valve which co-operates with a valve seat to vary the cross-sectional area of an auxiliary air supply passage upstream of a plug valve in the passage. The air valve is urged towards the valve seat by coil spring. A fuel metering orifice communicates with the passage between the two valves. The plug valve has a profiled valve member which is linked to a profiled needle which projects into the fuel metering orifice, the needle and the plug valve member being guided for rectilinear movement together along parallel paths to respectively throttle the passage and vary the area of the metering orifice. A coil spring opposes rectilinear movement of the plug valve member and the needle to reduce flow through the passage and the orifice respectivey. A thermostatically controlled movable stop co-operates with the linkage which links the plug valve member and the needle so as to limit the permitted movement of the plug valve member and the needle together against the action of the coil spring and to increase that permitted movement as the temperature of the engine increases. In one embodiment the air valve and the plug valve are coaxial, the air valve being annular and being guided by a rod which carries the plug valve member. In another embodiment the air valve is carried by a plunger which slides in a through bore in the body of the device, the through bore being parallel to the plug valve path and communicating with the passage downstream of the plug valve.

24 Claims, 5 Drawing Figures

37
68
33
69
79
80
82
78
88
17
60
81
83
86
87
84
61
13A
18
85
58
10

COLD STARTING DEVICES

This invention relates to cold starting devices for internal combustion engines, the cold starting devices being arranged so that, once the engine commences to run under its own power, the constitution of a fuel/air mixture supplied to the engine is changed progressively until the engine has obtained its normal operating temperature at which there is no further need for any extra fuel or air to be supplied to the engine by a cold starting device.

According to this invention there is provided a cold starting device for an internal combustion engine, the cold starting device comprising a valve member which is guided for rectilinear movement within an axuiliary air supply passage and which is biassed into an open position at least when the cold starting device is in use, the valve member being arranged so as to tend to be moved by engine suction into a closed position in which it restricts or prevents the flow of air past it to the engine, a fuel metering orifice which is in communication with the auxiliary air supply passage upstream of said closed position of said rectilinearly movable valve member so that metered quantities of fuel can be drawn therethrough into said auxiliary air supply passage by engine suction when said valve member is in the open position, and a thermostatically controlled movable stop for limiting rectilinear movement of the valve member towards said closed position, the position of said stop being related to engine temperature so that rectilinear movement of said valve member is minimised or prevented by said stop when the engine is cold and is allowed to increase as the engine warms up towards normal operating temperature whereat movement of said valve member to said closed position is permitted.

Preferably there is another valve member which is urged into engagement with a co-operating valve seat, the co-operating valve seat being positioned within said auxiliary air supply passage upstream of that part of the auxiliary air supply passage with which the fuel metering orifice communicates, the arrangement being such that the other valve member can be seated on said valve seat during the engine cranking period and moved by the depression which is established within said part of the auxiliary air supply passage against the action of the biassing load and away from said valve seat when the engine commences to run under its own power so that the constitution of fuel/air mixture supplied to the engine during starting from cold and warming up of the engine is changed firstly at the termination of the cranking period as well as being further changed progressively once the engine is running under its own power and until the engine has attained its normal operating temperature.

Conveniently said rectilinearly movable valve member is biassed into the open position by resilient means. Preferably said other valve member is guided for rectilinear movement towards and away from said co-operating valve seat and is urged into engagement with the co-operating valve seat by respective resilient means. Provision of the valve members which are guided for rectilinear movement renders coil springs particularly convenient for use as the associated resilient means, such coil springs being more convenient than torsion springs or other control spring arrangements which would be required if the valve members were of the butterfly type.

The first memtioned valve member may be a plug valve member which co-operates with an orifice in the auxiliary air supply passage to control the flow of fuel-/air mixture through the said orifice to the engine. The plug valve member may be profiled so that the flow of fuel/air mixture past it to the engine is metered in accordance with engine temperature. The profiled plug valve member may be fixed to a rod. Conveniently the rod is guided for rectilinear movement within the auxiliary air supply passage by being in sliding interengagement within a guide sleeve which is supported within the auxiliary air supply passage. Conveniently said other valve member is annular and is guided for rectilinear sliding movement by said rod which is a sliding fit within its central aperture.

Provision of valve members for controlling the supply of fuel/air mixture through the auxiliary air supply passage to the engine in response to the depression established by operation of the engine, the valve members being guided for rectilinear sliding movement along the auxiliary air supply passage, leads to a more effective utilisation of the engine suction loads than it the case if the valve members are of the butterfly type.

The first mentioned valve member, the associated orifice in the auxiliary air supply passage, the other valve member, the associated valve seat, and the respective resilient means acting on the two valve members may be arranged so that, during operation of the cold starting device, a substantially constant depression is maintained in that part of the auxiliary air supply passage which extends between the closed positions of the two valve members.

Conveniently a profiled needle is coupled to the first mentioned valve member and is guided for rectilinear movement with rectilinear movement of said first memtioned valve member, the profiled needle projecting into the fuel metering orifice so that the effective area of the fuel metering orifice is varied with movement of the first mentioned valve member. The profiled needle may be urged resiliently into the position in which the effective cross-sectional area of the fuel metering orifice is at its greatest, and conveniently the profiled needle is so urged by said resilient means which urge the first mentioned valve member into an open position.

Where the first mentioned valve member comprises a plug valve member mounted on a rod, the rod may carry a laterally extending arm. The arm may be fixed to the needle so that the profiled needle and the rod are parallel. The arm may co-perate with the thermostatically controlled movable stop so that movement of the plug valve member towards said closed position is limited by the movable stop.

Conveniently the position of the thermostatically controlled movable stop is controlled by an expansible capsule which is arranged to expand with increase in engine temperature. The expansible capsule may act on a pivoted beam which carries said stop and may act to permit rotation of the beam about its pivot support, due to the action of resilient means, as the engine temperature increases. The expansible capsule may be arranged so that the plug valve member is held closed when the engine has attained its normal operating temperature. The beam may be arranged to engage the other valve member and hold the other valve member displaced from its associated valve seat when the engine has attained its normal operating temperature.

Sesaling means may be provided for closing the fuel metering orifice when the engine has attained its normal operating temperature so as to prevent fuel being drawn through the fuel metering orifice into the auxiliary air supply passage when the engine has attained its normal operating temperature. Conveniently the sealing means are carried by the profiled needle.

An air metering device may be provided and aarranged so that metered quantities of air can be drawn therethrough for mixture with metered quantities of fuel drawn through the fuel metering orifice, the metered quantities of fuel and air being mixed between the fuel metering orifice and the auxiliary air supply passage.

A by-pass passage around the orifice with which said plug valve member co-operates may be provided so that limited quantities of air can be drawn from upstream of the plug valve member by engine suction when the said orifice is closed by the plug valve member and the fuel metering orifice is closed by said sealing when the engine has attained its normal operating temperature. The by-pass passage may incorporate an adjustable volume screw which enables the quantity of air drawn therethrough to be adjusted.

Means may be provided for supplying a mixture of metered quantities of air and fuel to the auxiliary air supply passage downstream of said first mentioned valve member when the engine has attained its normal operating temperature. The volume of such a mixture of metered quantities of fuel and air fed to the auxiliary air supply passage downstream of the first mentioned valve member when the engine has attained its normal operating temperature may be controlled by an adjustable volume screw.

Where said other valve member is annular, is guided for rectilinear sliding movement by said rod which is a sliding fit within its central aperture, and is urged into engagement with the co-operating valve seat by respective resilient means, said resilient means preferably comprise a coil spring having a diameter greater than the diameter of said orifice with which the plug valve member co-operates and greater than the diameter of the valve seat with which said annular valve member co-operates and the annular valve member preferably has radially outwardly projecting spokes which are engaged by said coil spring.

In a preferred embodiment of cold starting device according to this invention which includes both said valve members, said other valve member is connected to a movable wall so as to move with movement of the movable wall, the surface of the movable wall remote from said other valve member being exposed to the pressure which is existent in that part of the auxiliary air supply passage that is downstream of the closed position of said rectilinearly movable valve member so that the position of said other valve member relative to the co-operating valve seat is dependent upon the depression established within the auxiliary air supply passage downstream of the closed position of said rectilinearly movable valve member as well as upon the depression which is established within that part of the auxiliary air supply passage with which the fuel metering orifice communicates and the biassing load which acts to urge said other valve member toward said valve seat, the arrangement being such the depression established by engine suction within that part of the auxiliary air supply passage with which the fuel metering orifice communicates is a function of the depression established within the auxiliary air supply passage downstream of the closed position of said rectilinearly movable valve member. Conveniently the relationship between said biassing load and the dimensions of said other valve, said valve seat and said movable wall is such that the depression established by engine suction within said part of the auxiliary air supply passage with which the fuel metering orifice communicates is a function of the inverse of the depression established within the auxiliary air supply passage downstream of the closed position of the rectilinearly movable valve member. Preferably said other valve member is guided for rectilinear movement towards and away from said co-operating valve seat, is displaced laterally with respect to said rectilinearly movable member and is fixed to one end of a plunger which is engaged for sliding movement within a bore in a body within which said auxiliary air supply passage is defined, the other end of said plunger comprising said movable wall surface. Where said other valve member is urged into engagement with the co-operating valve seat by respective resilient means, said bore may be the bore of a tubular member which is housed in a bore in said body, and a coil spring, which functions as said resilient means may react against said tubular member, the location of said tubular member within said body being adjustable axially in order to alter the biassing load exerted by said coil spring upon said other valve member. Conveniently said tubular member is screwed into the bore in said body within which it is housed so that it can be rotated for axial adjustment relative to the body.

Several embodiments of this invention will be described now by way of example with reference to the accompanying drawings, of which:

Figure 1:
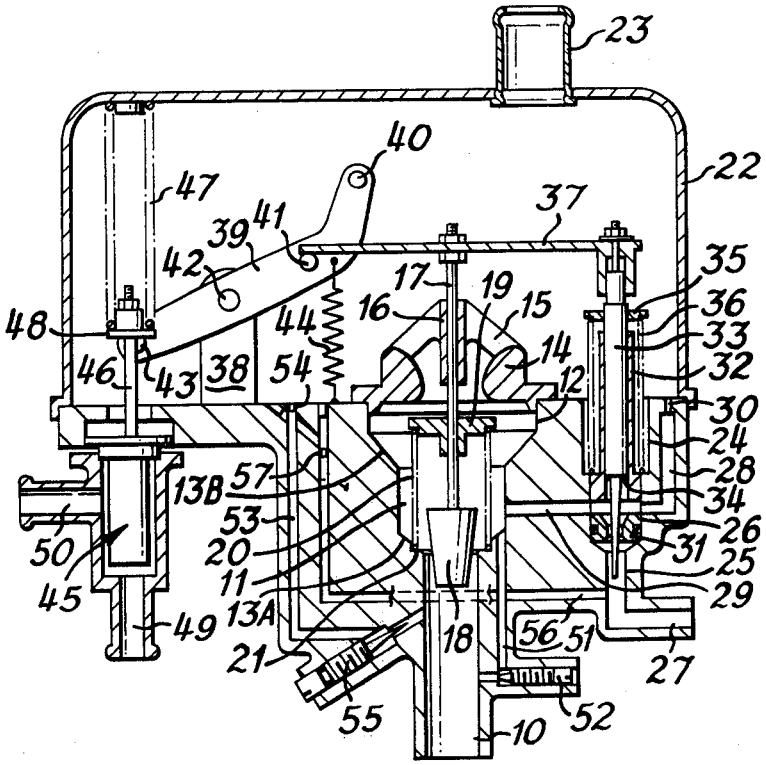
FIG. 1 is a schematic illustration of one form of automatic cold starting device according to this invention, the various parts of the device being shown in the positions they adopt when the engine is idling at a temperature (say 0°C) which is intermediate the range of temperature for which the device is designed to operate.

Referring to FIG. 1 of the drawings, the automatic cold starting device comprises a body which defines a stepped through bore which is composed of three cylindrical bore portions 10, 11 and 12 of different diameters, the two smaller diameter bore portions 10 and 11 being interconnected by a frusto-conical bore portion 13A, and the two larger diameter bore portions 11 and 12 being interconnected by another frusto-conical bore portion 13B. The smallest diameter bore portion 10 is arranged to be connected to the induction manifold of an internal combustion engine so that the stepped through bore is in communication with the induction manifold. The larger of the mouths at the ends of the through bore, which is defined by the largest diameter bore portion 12, receives an annular valve seat 14, which in turn supports, via radial spider arms 15, a cylindrical guide 16 for a rod 17. The rod 17 carries a profiled plug valve member 18 which co-operates with the orifice defined by the nearer end of the smallest diameter bore portion 10 to control fluid flow from the medial diameter bore portion 11 to the smallest diameter bore portion 10. The rod 17 is engaged slidably within the central aperturs of an annular valve member 19 which is urged to seat upon the annular valve seat 14 by a coil spring 20 which takes its reaction from an annular shoulder 21 formed in the frusto-conical portion 13A. The annular valve member 19 controls communication between the stepped through bore and an enclosure defined between the body and a cup-shaped cover 22 of sheet material which has an inlet port 23 for connection to the outlet of an air cleaner.

A through passage defined within the body has a stepped main bore portion which is substantially parallel with the through bore, and a laterally extending end bore portion which is for connection to a fuel float chamber. The largest diameter bore portion 24 of the stepped main bore portion is in direct communication with the enclosure defined between the body and the cover 22. The smallest diameter bore portion 25 of the stepped main bore portion is separated from the largest diameter bore portion 24 by the medial diameter bore portion 26 and communicates directly with the said laterally extending bore portion 27. The medial diameter bore portion 26 communicates with the enclosure defined between the body and the cover 22 via a passage 28 in the body and with the medial bore portion 11 of the stepped through bore via another passage 29 in the body. A restriction 30 in the passage 28 serves as an air metering orifice. An annular member 31 is fitted into that part of the medial diameter bore portion 26 which extends between the smallest diameter bore portion 25 on the one side and the passages 28 and 29 on the other side, the annular member 31 serving as a fuel metering orifice. The passages 28 and 29 communicate with the medial diameter bore portion 26 between the annular member 31 and a tubular guide 32 for a cylindrical member 33 which carries a profiled needle. The tubular guide 32 is spigotted into the medial diameter bore portion 26 of the through passage, extends through the largest diameter bore portion 24 of the through passage and projects into the enclosure defined between the body and the cover 22. The profiled needle projects through the fuel metering orifice and carries an annular sealing ring 34 at its largest diameter end which is the end that is attached to the cylindrical member 33. The cylindrical member 33 has a radial flange 35 at its end remote from the profiled needle. A coil spring 36 takes its reaction from the annular shoulder defined within the through passage between the intermediate diameter bore portion 26 and the largest diameter bore portion 24 and acts upon the annular flange 35 to urge the profiled needle into the position in which the profiled needle is withdrawn from the fuel metering orifice. A laterally extending arm 37 which is fixed at one end to the respective end of the cylindrical member 33 is carried by the rod 17 within the enclosure defined between the body and the casing 22.

A pillar 38 projects from the body into the enclosure defined between the body and the cover 22 and is on the side of the rod 17 remote from the cylindrical member 33. A beam 39 is hinged between its ends to the pillar 38. The beam 39 carries a peg 40 at its end nearer the rod 17, another peg 41 between the peg 40 and the hinge pin 42, and a third peg 43 at the other end. The arm 37 projects between the two pegs 40 and 41 so as to be engageable with either one of the two pegs 40 and 41. A tension spring 44 is anchored at one end to the body 10 between the pillar 38 and the rod 17 and at the other end to the beam 39 adjacent the peg 41.

A temperature sensitive capsule 45, which is mounted on the body, controls the angular position of the beam 39. The capsule 45 is filled with wax or other suitable substance having a high thermal expansion. The arrangement is such that, with increase of temperature, the wax or other substance expands and moves a rod 46 along its length against the action of a coil spring 47. The rod 46 projects from the capsule 45 into the enclosure defined between the body and the cover 22 and carries an annular flange 48 on the side of the peg 43 remote from the body. The spring 44 acts upon the beam 39 so as to hold the peg 43 in contact with the flange 48. The coil spring 47 reacts against the cover 22.

The temperature sensitive capsule 45 conveniently is sensitive to the engine water termperature, the pipes 49 and 50 being connected into the engine cooling system. However the temperature sensitive capsule 45 may be arranged so as to be sensitive to an electric heater or any other suitable means by which the angular position of the beam 39 can be related to the temperature of the engine.

A by-pass passage 51 in the body interconnects the frusto-conical bore portion 13A and the smallest diameter bore portion 10 of the stepped through bore. An adjustable volume screw 52 is provided within the body so as to enable the effective area of the outlet orifice by which the by-pass passage 51 communicates with the smallest diameter bore portion 10 to be adjusted.

An idling fuel/air mixture supply passage 53 in the body places the enclosure defined between the body and the cover 22 in communication with smallest diameter portion 10 of the stepped through bore. The passage 53 includes a restriction 54, which serves as an auxiliary air metering orifice, and an adjustable volume screw 55 which can be manipulated to adjust the effective area of the orifice by which the passage 53 communicates with the smallest diameter bore portion 10 of the stepped through bore. An auxiliary fuel supply passage 56 in the body places the smallest diameter bore portion 25 of the through passage in communication with the passage 53 between the restriction 54 and the volume screw 55. The auxiliary fuel supply passage 56 includes a restriction 57 which serves as an auxiliary fuel metering orifice.

When an engine, to which the cold starting device is fitted, is cold, the temperature sensitive capsule 45 allows the spring 47 to hold the rod 46 in the position in which the flange 48 is nearest to the body. Thus, due to the interengagement of the peg 43 and the flange 48, the beam 39 is held against the action of the tension spring 44 in the position in which the peg 40 is furthest from the body, the spring 44 being extended. The coil spring 36 acts through the flange 35 and the cylindrical member 33 to hold the arm 37 in its position furthest from the body and in contact with the peg 40. Thus the plug valve member 18 is spaced from the associated orifice. The peg 41 serves to stop movement of the arm 37 towards the body and thus to stop movement of the plug valve member 18 towards the associated orifice. The annular valve member 19 is seated upon the associated valve seat 14 by the action of the coil spring 20.

When the engine is cranked for starting, the parts remain in the position just described. Suction exerted by the engine causes a metered quantity of fuel to be drawn into the medial bore portion 11 of the stepped through bore through the fuel metering orifice defined by the annular member 31 and the passage 29. At the same time a metered quantity of air is drawn from the enclosure between the body and the cover 22 into the passage 28 via the orifice 30, the air so drawn is mixed within the passage 29 with fuel drawn through the fuel metering orifice, so as to form a fuel/air emulsion, and assists fuel flow through the passage 29. Fuel is drawn through the fuel metering orifice at a high rate because the profiled needle is withdrawn and the effective area of the fuel metering orifice is at its greatest.

With the engine begins to run under its own power, increased suction exerted by the engine acts to unseat the annular valve member 19 from the associated valve seat and to urge the plug valve member 18 towards its associated orifice. Movement of the plug valve member 18, and movement of the profiled needle with it, is limited by the stop 41 which abuts the arm 37. The coil spring 20 and the annular valve member 19 are arranged so that the depression in the medial bore portion 11 and the largest diameter bore portion 12, which together function as a mixing chamber, is maintained substantially constant.

As the engine temperature increases, the temperature sensitive capsule 45 urges the rod 46 against the action of the coil spring 47 thus allowing the beam 39 to be rotated by the action of the tension spring 44 in the direction which moves the peg 41 towards the body. Such movement of the peg 41 allows following movement of the arm 37, due to the action of engine suction on the plug valve member 18, so that the plug valve member 18 is moved to reduce the effective area of the associated orifice and the profiled needle is moved with it to reduce the effective area of the fuel metering orifice. This continues until the engine temperature has increased to the normal working temperature whereupon the plug valve member 18 reduces the effective area of the associated orifice in the through bore to a minimum and the sealing ring 34 carried by the profiled needle seats on the annular member 31 to close the fuel metering orifice.

It will be understood that the rate of flow of fuel through the fuel metering orifice is dependent upon the effective area of the fuel metering orifice and thus is altered in accordance with changes in engine temperature by the profiled needle which is allowed to move with changes in engine temperature. Likewise the rate of flow of fuel/air mixture through the orifice associated with the profiled plug valve member 18 is altered in accordance with changes in engine temperature by the profiled plug valve member 18 which is allowed to move with changes in engine temperature.

The degree of suction exerted by the engine upon the plug valve member 18 is reduced if the main throttle valve of the engine is opened for vehicle acceleration before the engine temperature reaches the normal working temperature. Furthermore if that reduction is sufficient to reduce the force which that suction exerts upon the plug valve member 18 to a force which is less than the opposing force exerted by the coil spring 36, the plug valve member 18 and the fuel metering meedle are moved to increase the effective area of the orifices with which they are associated. Such movement of the plug valve member 18 and the fuel metering needle is limited by engagement of the arm 37 with the peg 40. Thus the rate of flow of fuel drawn through the fuel metering orifice 31 and supplied to the medial diameter stepped bore portion 11 via the passage 29 is increased because of the action of the annular valve member 19 which functions to maintain the depression in the mixing chamber substantially constant, that is to say within acceptable upper and lower limits.

Air can still be drawn past the plug valve member 18 from the mixing chamber to the smallest diameter bore portion 10 of the stepped through bore and then to the engine inlet manifold, via the by-pass passage 51 once the plug valve member 18 has reduced to a minimum the area of the associated orifice in the through bore. The volume of air drawn through the by-pass passage 51 can be determined for engine idling conditions by the setting of the volume screw 52. Air which flows through the by-pass passage can be drawn into the smallest diameter bore portion 10 either past the annular valve member 19, or through the restrictor 30 and the passages 28 and 29. At the same time a controlled volume of fuel/air mixture can be drawn into the smallest diameter bore portion 10 from the idling fuel/air mixture supply passage 53, metered quantities of air being drawn into the passage 53 through the auxiliary air metering orifice 54 for mixture in the passage 53 with metered quantities of fuel drawn through the auxiliary fuel metering orifice 57. The volume of fuel/air mixture drawn from the passage 53 can be determined, for engine idling conditions, by the setting of the volume screw 55.

The fuel/air mixture drawn from the idling fuel/air mixture supply passage 53 and the air drawn through the by-pass passage 51 may be a proportion of the engine fuel requirements under engine idling conditions. Hot engine idle speed and fuel/air mixture strengths can be controlled by the setting of the volume screws 52 and 55.

Various modifications or refinements of the cold starting device described above with reference to FIG. 1 the accompanying drawing can be incorporated without departing from the scope of this invention. For example, the beam 39 may be projected beyond the peg 40, the extension being arranged to engage the annular valve member 19, hold it unseated and thereby minimise the depression established within the medial bore portion 11 when the plug valve member 18 is positioned to reduce the area of the associated orifice to a minimum. A non-return valve may be included in the auxiliary fuel supply passage 56 in order to oppose the flow of air from the smallest diameter bore portion 10 through the idling fuel/air mixture supply passage 53 and the auxiliary fuel supply passage 56 to the fuel metering orifice which could happen if the throttle valve of the carburetter, which supplies the fuel/air mixture to the engine when the engine has attained its normal working temperature, is opened before the engine has attained its normal working temperature.

Figure 3:
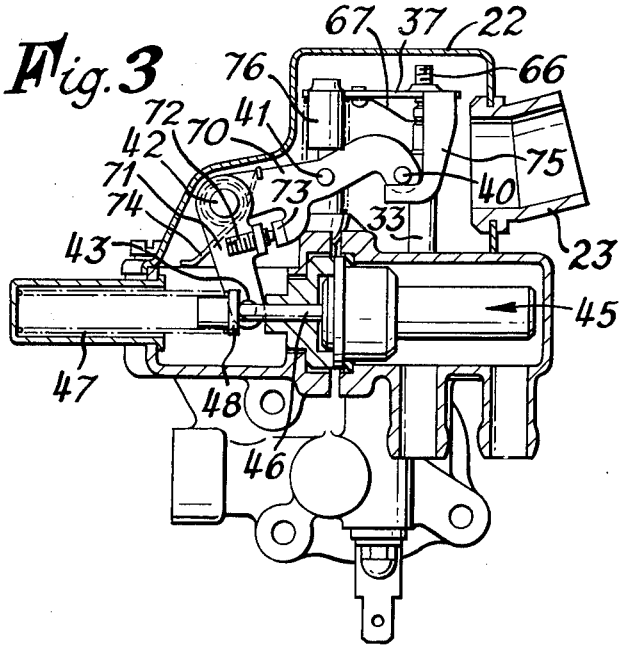
FIG. 3 is a section of the cold starting device shown in FIG. 2 which shows the thermostatically controlled mechanism the section being a plane substantially parallel to the plane of the section of FIG. 2, the thermostatically controlled mechanism being in the condition it adopts when the engine is cold and not running.
Figure 2:
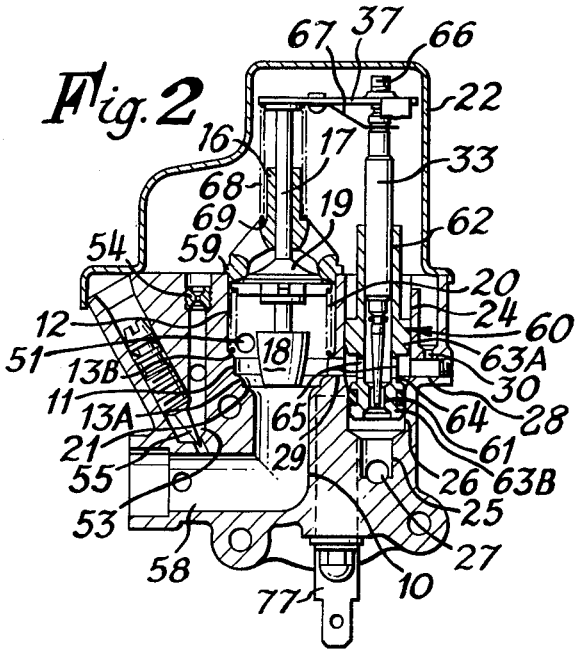
FIG. 2 is a transverse section through the fuel and air flow control valves of another form of automatic cold starting device according to this invention which is similar in most respects to that which is illustrated in FIG. 1, the various parts being shown in the positions they adopt when the engine is inoperative.

FIGS. 2 and 3 show an automatic cold starting device which is similar in most respects to that shown in FIG.

1. Parts of the device shown in FIGS. 2 and 3 which correspond with like parts of the device shown in FIG. 1 are identified by the reference numerals that were used for the like parts in the foregoing description of the device shown in FIG. 1. The main features by which the device shown in FIGS. 2 and 3 differs from the device shown in FIG. 1 are described below.

The stepped bore that defines the orifice with which the plug valve member 18 co-operates has its smallest diameter bore portion 10 connected to the induction manifold of an internal combustion engine by an additional bore 58 which runs at right angles to the stepped bore. The relative axial dimensions of the largest diameter bore portion 12 and the medial diameter bore portion differ from those of the device shown in FIG. 1 in that the largest diameter bore portion 12 is longer than the medial diameter portion 11. Instead of reacting against the annular shoulder 21 formed in the frusto-conical bore portion 13A of the device shown in FIG. 1 in order to urge the annular valve member 19 to seat upon the annular valve seat 14, the coil spring 20 reacts against an annular reaction surface afforded by the frusto-conical bore portion 13B and engages four radial spokes 59 which project radially from the radially outer periphery of the annular valve member 19. Thus the diameter of the coil spring 20 of the device shown in FIGS. 2 and 3 is greater than the diameters of both the annular valve seat 14 and the orifice with which the plug valve member 18 co-operates so that the turns of the coil spring 20 do not obstruct the path of air flow from the annular valve seat 14 to the orifice with which the plug valve member 18 co-operates nor do they obstruct the distibution within the mixing chamber of the air/fuel mixture fed to the medial diameter bore portion through the passage 29.

The tubular guide for the profiled fuel metering needle and the annular member which defines the fuel metering orifice are formed as a single integral tubular component 60 in the device shown in FIGS. 2 and 3. The tubular component 60 has a stepped through bore. The smaller diameter portion 61 of the stepped through bore serves as the fuel metering orifice. The cylindrical member 33, which carries the profiled fuel metering needle, slides within the larger diameter portion 62 of the stepped through bore. The outer cylindrical surface of the tubular component 60 is stepped and comprises a larger diameter cylindrical portion 63A, which is engaged in a fluid tight manner within the largest diameter bore portion 24 of the stepped main bore portion of the through passage within which the tubular component 60 is housed, and a smaller diameter cylindrical portion 63B which is engaged in a fluid tight manner within the medial diameter bore portion 26 of the said stepped main bore portion. An annular recess 64 is defined within the largest diameter bore portion 24 by that part of the tubular component 60 which is located therein and which separates the two cylindrical portions 63A and 63B. The passages 28 and 29 communicate with the annular recess 64. Radial passages 65 place the annular recess 64 in communication with the stepped through bore of the tubular component 60 immediately downstream of the fuel metering orifice 61.

The end of the cylindrical member 33 remote from the profiled needle which it carries is held against an adjuster screw 66 by a leaf spring 67 which is fixed to the arm 37. The adjuster screw 66 is carried by the arm 37 and is provided for adjusting the relative disposition of the profiled needle and the fuel metering orifice 61. A coil spring 68 reacts against an annular shoulder 69 defined by the outer surface of the cylindical guide 16 for the plug valve rod 17 and urges the arm 37 away from the body of the device. Thus the coil spring 68 has the same function as the coil spring 36 of the device shown in FIG. 1 which it replaces.

The beam 39 of the device shown in FIG. 1 is replaced by a pair of arms 70 and 71 which are both mounted pivotally on the hinge pin 42. The pegs 40 and 41 are carried by the arm 70 and the peg 43 is carried by the arm 71. The arm 71 carries an adjustable stop 72 which co-operates with an abutment 73 on the lever 70 so that the two arms 70 and 71 rotate together as one if the flange 48 is urged towards the temperature sensitive capsule 45 whilst the arm 71 can be moved in the opposite sense relative to the arm 70 and against the action of a torsion spring 74 which reacts against the body of the device and acts upon the arm 70 to urge the abutment 73 into contact with the adjustable stop 72. It will be apparent therefore that the function of the torsion spring 74 is analogous to that of the tension spring 44 of the device described above with reference to FIG. 1.

The arm 37 carries a cranked arm 75 the outer limb of which extends between the peg 40 and the body of the device and is engaged by the peg 40. The peg 41 co-operates with an abutment 76 which projects from the arm 37 parallel to the rod 17 and towards the arm 70. Provision of the two arms 70 and 71 and the adjustable stop 72 enables the device to be adjusted so that the peg 43 is in contact with the flange 48 and the peg 40 is in contact with the outer limb of the cranked arm 75 at the same time. FIG. 3 shows that the axes of the rod 46 and the spring 47 are normal to the axes of the plug valve rod 17 and the fuel metering meedle instead of being parallel thereto as in the device shown in FIG. 1.

The by-pass passage 51 communicates with the largest diameter bore portion 12 instead of with the medial diameter bore portion 11 as in the device shown in FIG. 1.

An electric heater element cartridge 77, which is spigotted into a closed ended bore which runs parallel and adjacent to the smallest diameter bore portion 10, is provided to minimise the incidence of ice being formed in the through passage during operation of the device.

The manner in which the cold starting device shown in FIGS. 2 and 3 operates will be apparent from the foregoing description of the device shown in FIG. 1.

Figure 4:
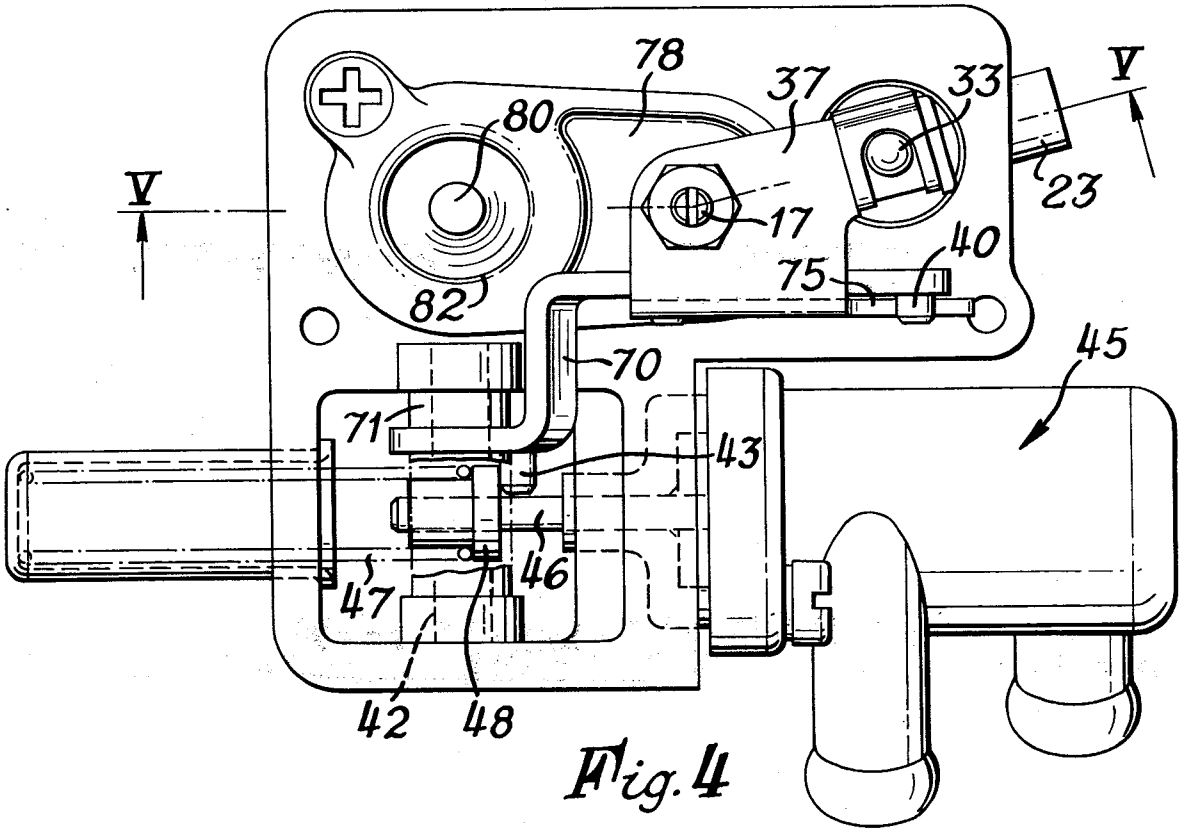
FIG. 4 is a plan view of a third form of automatic cold starting device according to this inveniton which is in a similar condition to the device shown in FIGS. 2 and 3.
Figure 5:
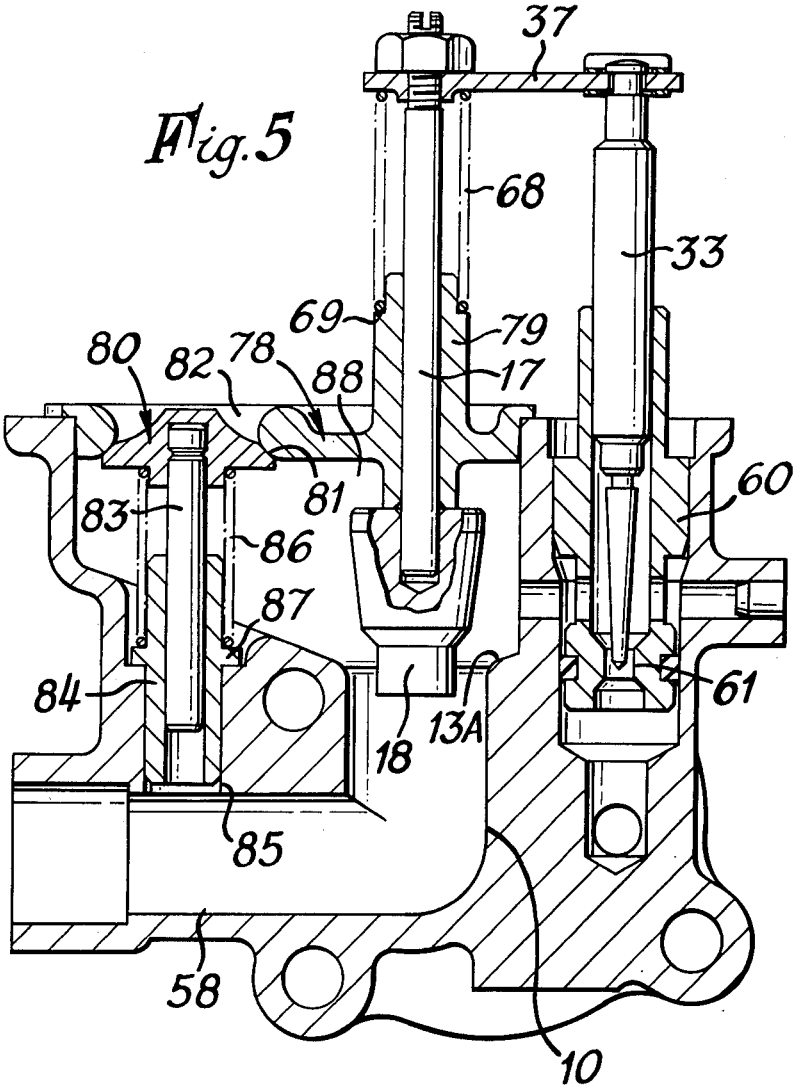
FIG. 5 is a section on the line V—V of FIG. 4.

FIGS. 4 and 5 show an automatic cold starting device which is similar in most respects to that shown in FIGS. 2 and 3. Parts of the device shown in FIGS. 4 and 5 which correspond with like parts of the device shown in FIGS. 2 and 3 are identified by the reference numerals that were used for the like parts in the foregoing description of the device shown in FIGS. 2 and 3. The main features by which the device shown in FIGS. 4 and 5 differs from the device shown in FIGS. 2 and 3 are described below.

The through passage that defines the orifice with which the plug valve member 18 co-operates is modified to eliminate the medial diameter bore portion and to replace the largest diameter bors portion by a chamber 88 which is closed at its upstream end by a closure plate 78. The plug valve rod 17 is guided for axial movement within a tubular guide 79 which is integral with the closure plate 78. The tubular guide 79 defines the annular shoulder 69 against which the coil spring 68 reacts.

The annular valve member 19 of the cold starting device described above with reference to FIGS. 2 and 3 of the accompanying drawings is dispensed with and a separate rectilinearly movable valve member 80 is provided instead. The valve member 80 co-operates with a valve seat 81 to close an aperture 82 formed in the closure plate 78. The tubular guide part 79 of the closure plate 78 is located between the aperture 82 and that part of the body of the device which houses the tubular component 60 that defines the fuel metering orifice 61 and guides the cylindrical member 33 that carries the fuel metering needle.

The valve member 80 is supported within the chamber 88 that is defined between the closure plate 78 and the orifice with which the plug valve closure member 18 co-operates by being mounted upon one end of a plunger 83. The plunger 83 slides within the bore of a tubular insert 84 which is housed within a through bore 85 formed in that part of the body of the device which extends between the bore 58 and the chamber 88. The axes of the plunger 83, the tubular insert 84 and the through bore 85 are parallel to the axes of the plug valve member rod 17 and the fuel metering needle cylindrical support member 33. A coil spring 86 reacts against an annular flange 87 formed on the outer surface of the tubular insert 84 and urges the valve member 80 to seat upon the annular valve seat 81. The end of the plunger 83 remote from the valve member 80 is exposed to the bore 58. The cross-sectional area of the plunger 83, the effective area of the valve member 80 which is exposed to the depression that is established in the chamber 88 and the loading of the coil spring 86 are selected so that the depression within the chamber 88 is a function of the inverse of the depression which exists in the bore 58 when the engine is running.

The fuel metering needle cylindrical support member 33 is connected to the arm 37 with clearance therearound so that it can move laterally relative to the arm 37 whilst being retained against axial movement relative thereto. The air supply passage 28 and related metering orifice 30, which are not shown in FIG. 5, may be omitted. In all other respects the fuel flow control valve assembly which comprises the combined fuel metering needle and cylindrical support member 33 and the tubular component 60 that is housed within the stepped bore portion of the through passage is substantially identical to the corresponding part of the device shown in FIGS. 2 and 3.

The device shown in FIGS. 4 and 5 also includes the temperature sensitive capsule 45 which is operatively coupled with the arm 37 in substantially the same manner as has been described above with reference to and as shown in FIGS. 2 and 3 of the accompanying drawings.

The basic operation of the device shown in FIGS. 4 and 5 of the accompanying drawings will be apparent from the foregoing description with reference to FIGS. 1 to 3 of the accompanying drawings. There is one significant difference however.

During operation of the cold starting device shown in FIGS. 4 and 5, the valve member 80 is urged against the action of the biassing spring 86, and thereby unseated from the co-operating valve seat 81, by the action upon the end of the plunger 83 remote from the valve member 80 of engine manifold depression which is established in the bore 58, as well as by the action of the depression established within the chamber 88. Thus the depression within the chamber 88 is a function of the inverse of the depression which exists in the bore 58. Consequently if the engine stalls or tends to stall before it has attained its normal operating temperature, the resultant reduction in the depression established in the bore 58 downstream of the orifice with which the plug valve member 18 co-operates will be accompanied by movement of the valve member 80 towards the co-operating valve seat 81 under the action of the biassing load exerted thereon by the coil spring 86, due to the reduction in the counterload exerted upon the plunger 83 by the depression in the bore 58 so that the depression established within the chamber 88 is increased. Such an increase in the depression established within the chamber 88 constitutes an increase in the fuel demand signal by which fuel is drawn through the fuel metering orifice 61 so that a greater quantity of fuel is supplied to the engine to counteract the tendency for the engine to stall. On the other hand, if, once the engine begins running under its own power, the engine speed increases progressively until the engine has attained its normal operating temperature, the accompanying progressive increase in the depression established by engine suction in the bore 58 will be accompanied by a progressive decrease in the depression established within the chamber 88 so that the fuel demand signal is reduced progressively and the air fuel mixture supplied to the engine is weakened progressively as the temperature of the engine approaches the normal operating temperature.

The axial position of the tubular insert 84 within the bore 85 may be adjusted in order to alter the biassing load exerted by the coil spring 86 and thereby to alter the relationship between the depression in the bore 58 and the depression in the chamber 88.

The tubular insert 84 may be mounted adjustably within the bore 85 by tapping the bore 85, forming a co-operating screw thread on the outer cylindrical surface of the tubular insert 84 and screwing the insert into the tapped bore 85. The axial position of the tubular insert 84 can then be altered easily by rotating the tubular insert 84. An especially convenient arrangement for rotating such a tubular insert 84 comprises the provision of a pair of tabs on the side of the valve member 80 which is nearer to the tubular insert 84, the tabs conveniently being aligned diametrically on opposite sides of the plunger 83, the formation of a corresponding pair of slots in the adjacent end face of the tubular insert 84 and the provision or formation of a hexagonal head, screwdriver slot or a hexagonal socket in the crown of the valve member 82 which is accessible through the aperture 82 when the valve member 80 is seated upon the co-operating valve seat 81. When it is desired to rotate the tubular insert 84 in order to change its axial position within the bore 85, the hexagonal head, screwdriver slot or hexagonal socket is engaged by the corresponding tool and depressed, against the action of the coil spring 86, until the tabs engage within the corresponding slots in the tubular insert 84. The valve member 84 and the tubular insert 84 are then rotated together by the tool until the tubular insert 84 has been repositioned as desired. The tool is then removed allowing the valve member 80 to reseat upon the valve seat 81.

It is known that the optimum air/fuel ratio varies with changes in engine loading and, in certain circumstances it is possible that it may be desirable to control the depression established in the chamber 88 so that it is substantially constant or so that it is directly proportional to the depression which exists in the bore 58 when the engine is running. It will be appreciated that the cross-sectional area of the plunger 83, the effective area of the valve member 80 which is exposed to the depression that is established in the chamber 88 and the loading of the coil spring 86 can be selected so that the depression established within the chamber 88 is constant or is any desired function of the depression established in the bore 58 when the engine is running.

I claim:

1. A cold starting device for an internal combustion engine, the cold starting device comprising an auxiliary air supply passage; a first valve member within said auxiliary air supply passage; first biasing means which bias said valve member into an open position at least when the cold starting device is in use, the valve member being arranged so as to tend to be moved when the device is installed on an internal combustion engine by engine suction into a closed position in which it minimizes the flow of air past it to the engine; guide means which guide said valve member for rectilinear movement within said auxiliary air supply passage between said open and closed positions; a fuel metering orifice; conduit means which place said fuel metering orifice in communication with the auxiliary air supply passage upstream of said closed position of said valve member so that metered quantities of fuel can be drawn therethrough into said auxiliary air supply passage by engine suction when said valve member is in the open position; and a thermostatically controlled movable stop for limiting the movement of the valve member towards said closed position, the position of said stop being related to engine temperature so that movement of said valve member is minimized by said stop when the engine is cold and is allowed to increase as the engine warms up towards normal operating temperature whereby movement of said valve member to said closed position is permitted, wherein the improvement comprises a second valve member; a cooperating valve seat positioned within said auxiliary air supply passage upstream of that part of the auxiliary air supply passage with which the fuel metering orifice communicates; second biasing means which urge the second valve member into engagement with said valve seat; the arrangement being such that the second valve member can be seated on said valve seat during the engine cranking period and moved by the depression which is established within said part of the auxiliary air supply passage against the action of the biasing load and away from said valve seat when the engine commences to run under its own power so that the constitution of fuel/air mixture supplied to the engine during starting from cold and warming up of the engine is changed firstly at the termination of the cranking period as well as being further changed progressively once the engine is running under its own power and until it has attained its normal operating temperature.

2. A cold starting device as claimed in claim 1, wherein said first biassing means comprises a coil spring.

3. A cold starting device according to claim 1, wherein said second valve member is guided for rectilinear movement towards and away from said co-operating valve seat and said second biassing means comprise a coil spring.

4. A cold starting device according to claim 1, wherein the first valve member is a plug valve member which co-operates with an orifice in the auxiliary air supply passage to control the flow of fuel/air mixture through the said orifice to the engine, the plug valve member being profiled so that the flow of fuel/air mixture past it to the engine is metered in accordance with engine temperature.

5. A cold starting device according to claim 4, wherein the profiled plug valve member is fixed to a rod, and said guide means comprise a guide sleeve which is supported within the auxiliary air supply passage, the rod being in sliding engagement within the guide sleeve by which it is guided for rectilinear movement.

6. A cold starting device according to claim 5, including a profiled needle; coupling means for coupling said profiled needle to the valve member and further guide means for guiding said profiled needle for rectilinear movement with movement of said valve member, the profiled needle projecting into the fuel metering orifice so that the effective area of the fuel metering orifice is varied with movement of the valve member, wherein said first biassing means comprise a coil spring which urges the profiled needle into the position in which the effective cross-sectional area of the fuel metering orifice is at its greatest.

7. A cold starting device according to claim 6, wherein an arm is carried by the rod, from which it extends laterally, and is fixed to the needle so that the profiled needle and the rod are parallel, the arm being associated with the thermostatically controlled movable stop so that movement of the plug valve member towards said closed position is limited by the movable stop.

8. A cold starting device according to claim 1, including an expansible capsule by which the position of the thermostatically controlled movable stop is controlled, the expansible capsule being arranged to expand with increase in engine temperature; and a pivoted beam which carries said stop; wherein the expansible capsule acts to permit rotation of the beam about its pivot support, due to the action of resilient means, as the engine temperature increases.

9. A cold starting device according to claim 8 wherein the expansible capsule acts to hold the valve member in its closed position when the engine has attained its normal operating temperature.

10. A cold starting device according to claim 5 wherein said second valve member is annular and is guided for rectilinear sliding movement by said rod which is a sliding fit within its central aperture.

11. A cold starting device as claimed in claim 1, wherein said second valve member is connected to a movable wall so as to move with movement of the movable wall, the surface of the movable wall remote from said other valve member being exposed to the pressure which is existent in that part of the auxiliary air supply passage that is downstream of the closed position of said rectilinearly movable valve member so that the position of said second valve member relative to the co-operating valve seat is dependent upon the depression established within the auxiliary air supply passage downstream of the closed position of said rectilinearly movable valve member as well as upon the depression which is established within that part of the auxiliary air supply passage with which the fuel metering orifice communicates and the biassing load which acts to urge said second valve member towards said valve seat.

12. A cold starting device according to claim 11, wherein the relationship between said biassing load and the dimensions of said second valve member, said valve seat and said movable wall is such that the depression established by engine suction within that part of the auxiliary air supply passage with which the fuel metering orifice communicates is a function of the inverse of the depression established within the auxiliary air supply passage downstream of the closed position of the rectilinearly movable valve member.

13. A cold starting device according to claim 11 wherein said second valve is guided for rectilinear movement towards and away from said co-operating valve seat, is displaced laterally with respect to said rectilinearly movable valve member and is fixed to one end of a plunger which is engaged for sliding movement within a bore in a body within which said auxiliary air supply passage is defined, the other end of said plunger comprising said movable wall surface.

14. A cold starting device according to claim 13, wherein said second biassing means comprise a coil spring, said bore is the bore of a tubular member housed in a bore in said body, and the coil spring reacts against said tubular member, the location of said tubular member within said body being adjustable axially in order to alter the biassing load exerted by said coil spring upon said other valve member.

15. A cold starting device according to claim 14, wherein said tubular member is screwed into the bore in said body within which it is housed so that it can be rotated for axial adjustment relative to the body.

16. A cold starting device according to claim 10, wherein said first biasing means comprises a coil spring which has a diameter greater than the diameter of said orifice with which the plug valve member co-operates and greater than the diameter of the valve seat with which said annular valve member co-operates and the annular valve member has radially outwardly projecting spokes which are engaged by said coil spring.

17. A cold starting device according to claim 8 wherein the beam is adapted to engage said second valve member and hold said second valve member displaced from its associated valve seat when the engine has attained its normal operating temperature.

18. A cold starting device for an internal combustion engine, the cold starting device comprising an auxiliary air supply passage; one end of the auxiliary air supply passage being for connection to the inlet manifold of an internal combustion engine so that air can be drawn through the auxiliary air supply passage by the action of engine suction when the device is installed on an internal combustion engine; throttling means for throttling such air flow through the auxiliary air supply passage; means for varying the effective cross-sectional area of a part of said auxiliary air supply passage upstream of said throttling means so as to control the depression established within the auxiliary air supply passage between said passage part and said throttling means, yieldable biassing means for biassing said area varying means to minimise the effective cross-sectional area of said passage part, said yieldable biassing means acting in opposition to the effect upon said area varying means of a depression established within the auxiliary air supply passage between said passage part and said throttling means which tends to increase the effective area of said passage part; and a fuel control valve which is operable to allow fuel to be drawn from a fuel supply system into the auxiliary air supply passage between said passage part and said throttling means by the action of a depression which is established in the auxiliary air supply passage between said passage part and said throttling means, wherein the improvement comprises a movable wall having a surface which is exposed to the pressure which is existent in the auxiliary air supply passage downstream of said throttling means, the movable wall being coupled to the area varying means by thrust transmitting means so that the thrust due to the action on said movable wall surface of the pressure in said auxiliary air supply passage downstream of said throttling means is transmitted to said area varying means to act thereon in opposition to the action of said yieldable biassing means, the arrangement being such that the effective cross-sectional area of said passage part is dependent upon the depression established with the auxiliary air supply passage downstream of said throttling means by engine suction as well as upon the depression which is established within the auxiliary air supply passage between said passage part and the throttling means, and upon the biassing load exerted by yieldable biassing means.

19. A cold starting device according to claim 18, wherein the throttling means comprise a throttle valve having a throttle valve member and biassing means which bias said throttle valve member into an open position at least when the cold starting device is in use, the throttle valve member being arranged so as to tend to be moved by engine suction into a closed position in which it minimises the flow of air past it to the engine.

20. A cold starting device according to claim 19, including guide means which guide said throttle valve memeber for rectilinear movement within said auxiliary air supply passage between said open and closed positions.

21. A cold starting device according to claim 19, including a thermostatically controlled movable stop for limiting movement of said valve member towards said closed position, the position of said stop being related to engine temperature so that the permitted movement of said valve member is minimised by said stop when the engine is cold and is increased as the engine warms up towards normal operating temperature whereby movement of said valve member to said closed position is permitted.

22. A cold starting device according to claim 18, wherein said area varying means comprise a valve member, and a co-operating valve seat positioned within said auxiliary air supply passage upstream of said throttling means, said yieldable biassing means urging said valve member into engagement with said valve seat.

23. A cold starting device according to claim 22, wherein said yieldable biassing means comprise a coil spring.

24. A cold starting device according to claim 22, wherein said passage part is displaced laterally with respect to said throttling means and said valve member is fixed to one end of a plunger which is engaged for sliding movement within a bore in a body within which said auxiliary air supply passage is defined, the other end of said plunger comprising said movable wall surface.

* * * * *